US007988146B2

(12) United States Patent
Chou

(10) Patent No.: US 7,988,146 B2
(45) Date of Patent: Aug. 2, 2011

(54) MEDIA FIXING DEVICE

(75) Inventor: Chia-Hung Chou, Taipei Hsien (TW)

(73) Assignee: Hon Hai Precision Industry Co., Ltd., Tu-Cheng, New Taipei (TW)

( * ) Notice: Subject to any disclaimer, the term of this patent is extended or adjusted under 35 U.S.C. 154(b) by 168 days.

(21) Appl. No.: 12/424,524

(22) Filed: Apr. 15, 2009

(65) Prior Publication Data

US 2010/0052245 A1 Mar. 4, 2010

(30) Foreign Application Priority Data

Aug. 27, 2008 (CN) ..... 2008 1 0304236

(51) Int. Cl.
*B65H 1/12* (2006.01)

(52) U.S. Cl. ..... 271/160; 271/126

(58) Field of Classification Search ..... 271/160, 271/126, 3.01, 149, 147, 177
See application file for complete search history.

(56) References Cited

U.S. PATENT DOCUMENTS

| | | | | |
|---|---|---|---|---|
| 4,078,788 | A * | 3/1978 | Bellis et al. | 271/128 |
| 4,285,510 | A * | 8/1981 | Kanno et al. | 271/127 |
| 4,726,698 | A * | 2/1988 | Weiss et al. | 400/629 |
| 2003/0137095 | A1* | 7/2003 | Ito et al. | 271/176 |
| 2004/0245708 | A1* | 12/2004 | Takeuchi | 271/177 |
| 2007/0273082 | A1* | 11/2007 | Sawai | 271/147 |

FOREIGN PATENT DOCUMENTS

| | | | |
|---|---|---|---|
| JP | 62215461 | A * | 9/1987 |
| JP | 05246571 | A * | 9/1993 |

* cited by examiner

*Primary Examiner* — Kaitlin S Joerger
(74) *Attorney, Agent, or Firm* — Zhigang Ma

(57) ABSTRACT

A media fixing device includes a stationary plate, a bar linking member, a main pressure plate, an elastic member, an auxiliary plate and a pivot rod. The bar linking member is configured for movably connecting the main pressure plate. The elastic member is configured for movably connecting the main pressure plate to the stationary plate. The pivot rod is configured for pivoting the auxiliary plate on the main pressure plate.

17 Claims, 5 Drawing Sheets

MEDIA FIXING DEVICE

BACKGROUND

1. Technical Field

The disclosure relates to printing technology and, particularly, to a media fixing device used in a printer.

2. Description of the Related Art

Media-storage elements are widely provided in printer, duplicator, camera-printer or similar devices for storing paper, films, or other sheet media. To compress the media stored therein, a media fixing device is attached to a cover thereof. A media fixing device often employed includes a spring fixed on one end to the cover of the media storage device and a pressure plate on the other end of the spring applying pressure to the media. In such a media fixing device, however, pressure is not uniformly distributed over the media. As a result, the media can jam in the paper storage devices.

Therefore, it is desirable to provide a media fixing device which can overcome or at least alleviate the limitations described.

DETAILED DESCRIPTION

Figure 1:
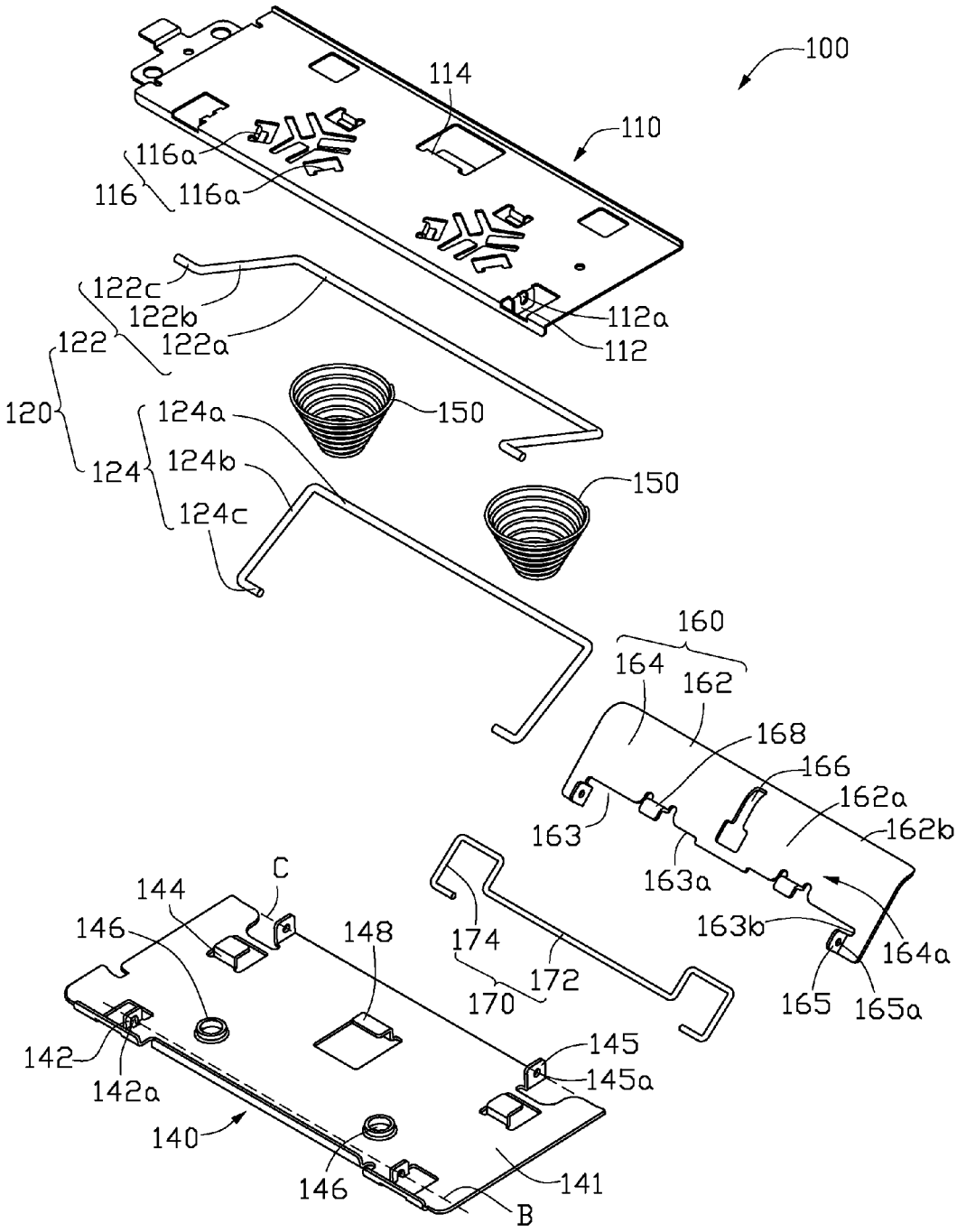
FIG. 1 is an isometric, exploded view of a media fixing device, according to an exemplary embodiment.
Figure 2:
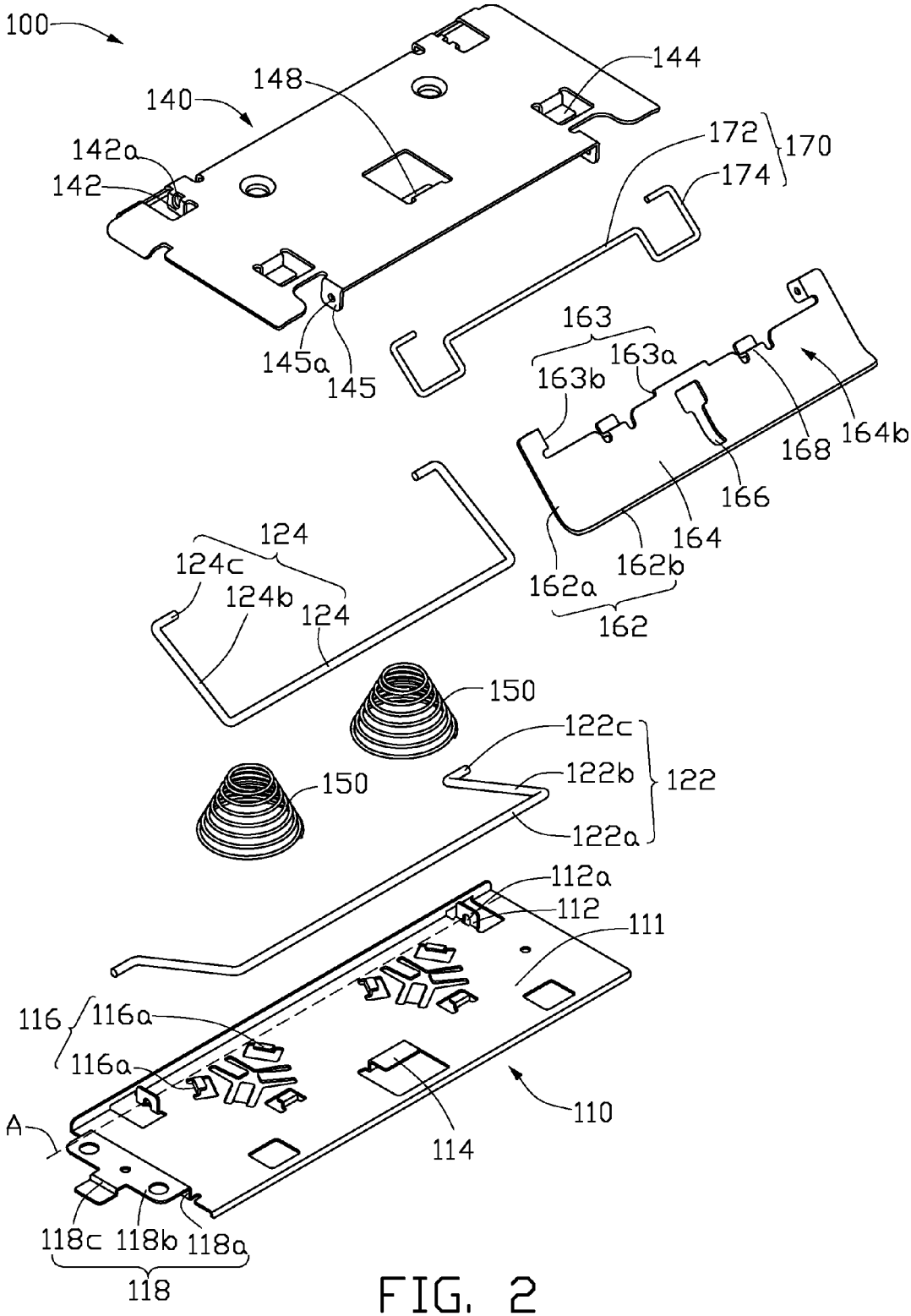
FIG. 2 is similar to the FIG. 1 but shows the media fixing device from a reverse direction.
Figure 3:
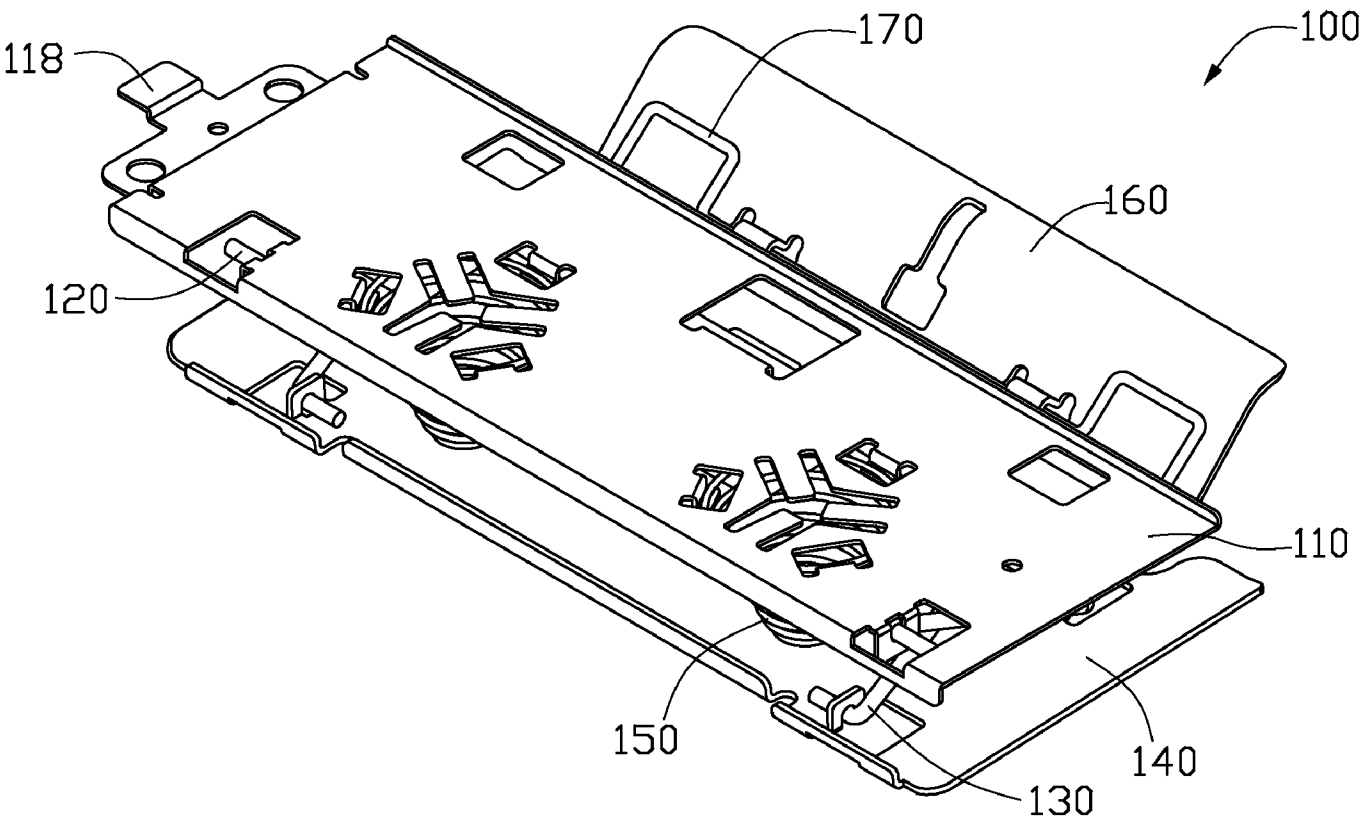
FIG. 3 is an isometric, assembled view of the media fixing device of FIG. 1.
Figure 4:
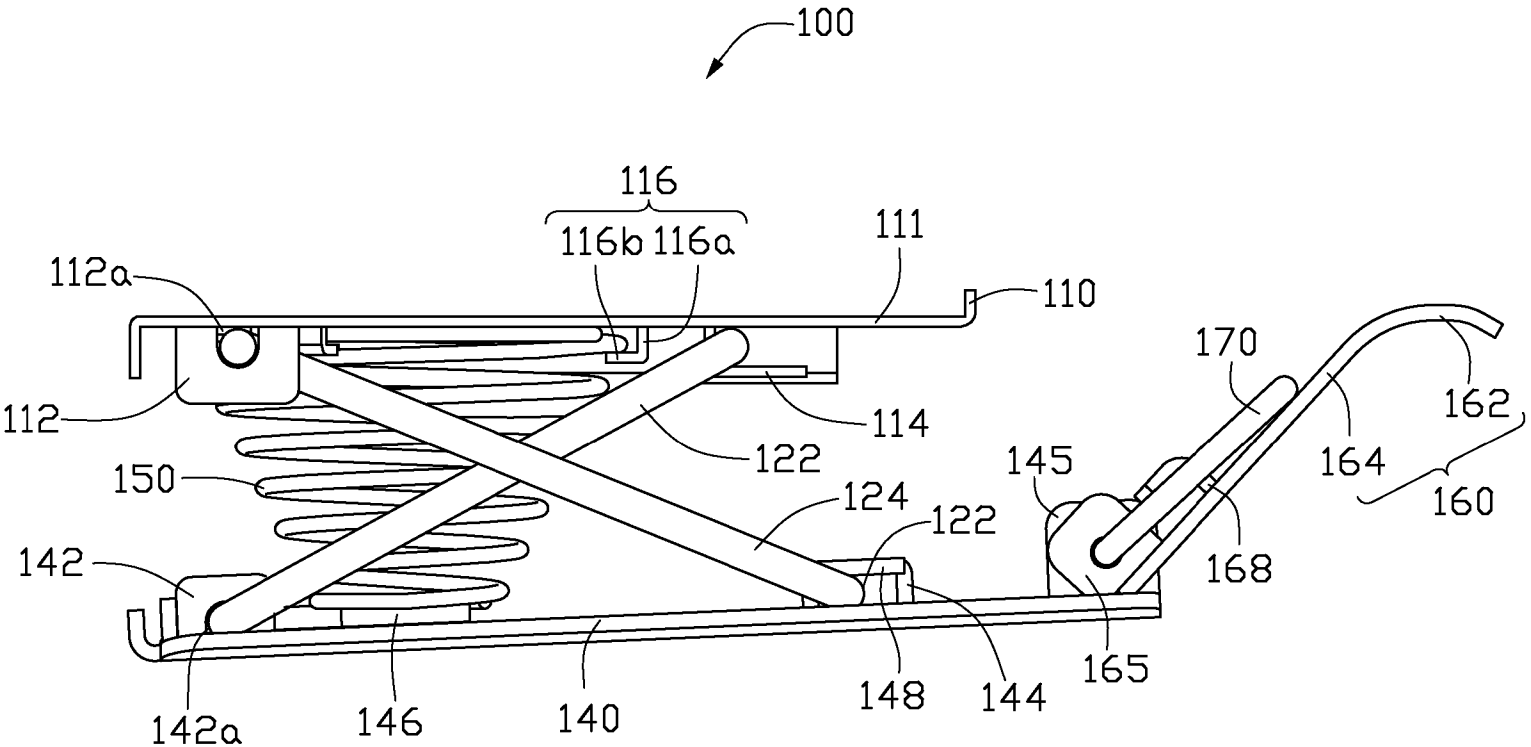
FIG. 4 is a lateral view of the media fixing device of FIG. 3 in a first state.

Referring to FIGS. 1 and 2, a media fixing device 100 includes a stationary plate 110, a bar linking member 120, a main pressure plate 140, two elastic members 150, an auxiliary pressure plate 160, and a pivot rod 170. The stationary plate 110 is fixed to an external fixture (not shown) such as a cover of a paper storage device. The linking member 120 includes a first linking bar 122 and a second linking bar 124. The main pressure plate 140 is hinged on the stationary plate 110 by the first and second linking bars 122, 124 of the bar linking member 120 and elastically connected to the stationary plate 110 by the elastic member 150. The auxiliary pressure plate 160 is rotatably connected to the main pressure plate 140 by the pivot rod 170.

The stationary plate 110 is rectangular and includes a mounting surface 111, a pair of first joining members 112, a first clip 114, two locating seats 116, and a connecting plate 118. The first joining members 112 are separately and perpendicularly formed on the mounting surface 111, each being a plate extending upwards with a fulcrum hole 112*a* defined therein and running through the plate. The pair of fulcrum holes 112*a* are aligned to form a pivot axis labeled A, with respect to which the first linking bar 122. Here, the joining members 112 are formed by punching from the stationary plate 110. Alternatively, they can be prepared separately and fixed to the stationary plate 110. The first clip 114 includes a first portion extending upwards from the mounting surface 111 and a second portion extending from the first portion and away from the first pivot axis A defined by the fulcrum hole 112*a* of the first joining member 112. The locating seat 116 is formed on the mounting surface 111. Here, each of the locating seat 116 includes three symmetrically distributed retaining tabs 116*a*, each of which includes a first portion extending upwards from the mounting surface 111 and a second portion extending from the first portion and towards the center of the three retaining tabs 116*a*. The connecting plate 118 extends from the stationary plate 110 and is configured for fixing the media fixing device 100 to the external fixture. Here, the connecting plate 118 includes a rib plate 118*a* perpendicularly connected to the side edge of the stationary plate 110, a locating plate 118*b* perpendicularly connected to the rib plate 118*a* and parallel with the stationary plate 110, and a step-like wing member 118*c* connected to the locating plate 118*b*.

The first linking bar 122 and a second linking bar 124 of the bar linking member 120 are interleaved to form a scissor-like structure connected to the stationary plate 110 and the main pressing 140, allowing main pressure plate 140 to fold and unfold relative to the stationary plate 110. Each of first and second linking bars 122, 124 includes a sliding portion and two pivot portions parallel therewith and connected thereto by two connecting portions. Here, the first linking bar 122 includes a first sliding pole 122*a* serving as the sliding portion, two first connecting poles 122*b* serving as the connecting portions, and two first pivoting poles pivoting portions 122*c* serving as the pivot portions. The first pivoting poles 122*c* are connected parallel to the opposite ends of the first sliding pole 122*a* via the first connecting poles 122*b* respectively, wherein, the first rotating poles 122*c* extend beyond and parallel to the opposite ends of the first sliding pole 122*a*. The second linking bar 124 includes a second sliding pole 124*a* serving as the sliding portion, two second connecting poles 124*b* serving as the connecting portions, and second pivoting poles 124*c* serving as the pivot portions. The pivoting poles 124*c* are parallel and connected on the opposite ends of the second sliding pole 124*a* via the second connecting poles 124*b*, wherein the second rotating poles 124*c* extend inwards with respect to the opposite ends of the first sliding pole 122*a* and parallel thereto. It should be mentioned that the bar linking member 120 can have any other form/configuration that can still connect the stationary plate 110 and the main pressure plate 140 and allow the main pressure plate 140 to move perpendicularly with respect to the stationary plate 110.

The main pressure plate 140, similar to stationary plate 110, includes a connecting surface 141, a pair of second joining members 142, a pair of second clips 144, two locating rings 146, a auxiliary clip 148, and a pair of third joining members 145. The pair of second joining members 142 are separately and perpendicularly formed on the connecting surface 141, similar to first joining member 112 with a fulcrum hole 142*a* defined therein. The fulcrum holes 142*a* align to define a second pivot axis B, away from which second clips 144 are separately formed on the connecting surface 141. Each second clip 144 is formed similar to the first clip 114, including a first portion extending upwards from the connecting surface 141 and a second portion extending from the first portion and away from the pivot axis B defined by the fulcrum holes 142*a*. The locating rings 146 are formed on the connecting surface 141 corresponding to the locating seats 116. The auxiliary clip 148 is formed on the connecting surface 141 of the main pressure plate 140 between the second clips 144 and includes a first portion extending upwards from the connecting surface 141 and a second portion extending from the first portion towards the pivot axis B defined by the fulcrum holes. The first portion of the auxiliary clip 148 is offset away from a connecting line between the second clips 144 and away from the pivot axis B defined by the fulcrum holes 142*a* of the second joining members 142. The auxiliary clips 148 are configured for preventing the bar linking members 120 from disengaging from the second clips 144. The pair of third joining members 145 is separately and perpendicularly formed at an edge position on the connecting surface 141, similar to the second joining member 142, having a fulcrum hole 145*a* defined therein. The fulcrum holes 145*a* align to define a third pivot axis labeled as C around which pivot rod 170 and the auxiliary plate 160 rotate.

Here, the each of the elastic members 150 is a volute spring, which can be, by definition, limited to functioning within a single plane. It should be mentioned that elastic member 150 can be directly joined to the two separate first and second linking bars 122, 124, and is not limited in the configuration disclosed.

The auxiliary plate 160 includes an arched portion 162 and a connecting portion 164 connected to the arched portion 162. The arched portion 162 is elastic material and includes an upper end 162*a* and a lower end 162*b*. The connecting portion 164 includes a first surface 164*a*, a second surface 164*b* opposite thereto, an opening 163, a pair of fourth clips 168, and a pair of fourth joining members 165. The arched portion 162 is connected to the connecting portion 164 by the upper end 162*a*, and the concavity thereof faces downwards. The opening 163 is defined in a side edge position on the connecting portion 164 away from the arched portion 162. The opening 163 is surrounded by a bottom wall 163*a* and two parallel sidewalls 163*b* symmetrically connected to two opposite ends of the bottom wall 163*a*. The pair of fourth clips 168 is separately and perpendicularly formed on auxiliary plate 160 along the bottom wall 163*a*, and each includes a first portion extending from the auxiliary plate 160 and a second portion extending from the first portion towards opening 163. The pair of joining members 165 are similar to third joining members and perpendicularly formed on the auxiliary plate 160 along the sidewalls 163*b*, with each defining a fulcrum hole 165*a* through which pivot rod 170 enters and pivots on the third joining members 145 of the main pressure plate 140. A sliding slot 166 is defined in the middle of the auxiliary plate 160 and impels the auxiliary plate 160 from the bottom wall 163*a* to the lower end 162*b* of the arched portion 162. An end of sliding slot 166 adjacent to bottom wall 163*a* is wider than other portion of the sliding slot 166, by which a sliding pole entering thereinto guides the auxiliary plate 160 therealong.

The pivot rod 170 includes a connecting portion 172 and two pivot portions 174 connected to both ends thereof. The pivot rod 170 serves as a connecting shaft rotatably connecting auxiliary plate 160 to the main pressure plate 140.

In assembly, referring to FIGS. 1 to 4, the at least one elastic member 150 is received in the locating seats 116 of the stationary plate 110 via one end thereof, and the other end thereof 150 is coiled around the locating ring 146 of main pressure plate 140. The pivot portions of the first and second linking bar 122,124 of the bar linking member 120 respectively pivot in the fulcrum holes 112*a*, 142*a* of the first and second joining members 112, 114. The sliding portions of the first and second linking bar 122, 124 of the bar linking member 120 are respectively disposed in the gaps defined between each of first to third clips 114, 144, 148 and the corresponding plate 140 on which the first to third clips are formed. In sequence, the pivot rod 170 rotatably connects the auxiliary plate 160 to the main pressure plate 140 by the pivot portion thereof being received in fulcrum hole 165*a* of the fourth joining member 165 of the auxiliary plate 160 and pivoting in the fulcrum hole 145*a* of the third joining member 145 of the main pressure plate 140. It should be mentioned that the locating seat 116 can alternatively present other forms capable of locating/holing the elastic member 150 on the stationary plate 110 while remaining well within the scope of the disclosure.

Figure 5:
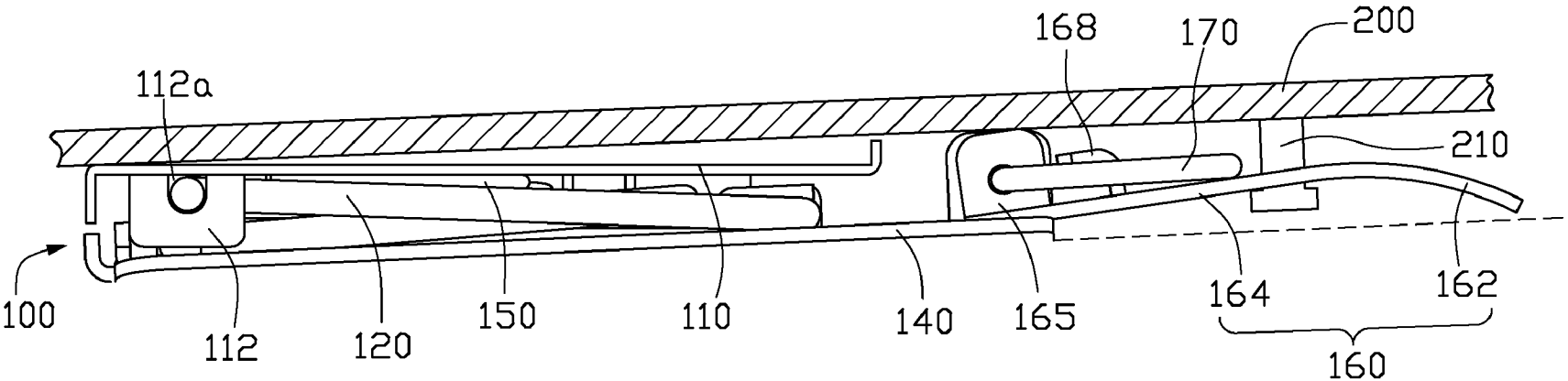
FIG. 5 is a lateral view of the compressed media fixing device of FIG. 3 in a second state.

In use, referring to FIG. 5, the media fixing device 100 is mounted on a cover 200 of a media storage bay (not shown) by the stationary plate 110, and the auxiliary plate 160 is slidably attached to the sliding pole 210 through the sliding slot 166 of the auxiliary plate 160. When media is stored in the media storage bay, the main pressure plate 140 presses against the media and the elastic member 150 is compressed as the main pressure plate 140 rises corresponding to the cover 200. As the elastic member 150 is compressed by the main pressure plate 140, the auxiliary plate 160 pivoting on the main pressure plate 140 is raised and rotated around the third joining member 145 of the main pressure plate by one end thereof. The other end, opposite to the pivoting end of the auxiliary plate 160, travels along the sliding pole 210 of the cover 200 and the lower end 162*b* of the arched portion 162 contacts the media and elastically deforms thereagainst. Thus, media stored in the media storage bay is uniformly compressed by the main pressure plate 140 and the auxiliary plate 160 of the media fixing device 100, avoiding potential jamming thereof.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

The invention claimed is:

1. A media fixing device comprising:

a stationary plate comprising a mounting surface, a pair of first joining members and a first clip formed on the mounting surface;

a main pressure plate comprising a connecting surface, a pair of second joining members and a pair of second clips formed on the connecting surface;

a bar linking member configured for linking the main pressure plate to the stationary plate, and comprising a first linking bar and a second linking bar; the first linking bar pivoted on the first joining member by one end and travels in a gap between the second clips and the main pressure plate by the other end; the second linking bar pivoted on the second joining member by one end thereof and travels in a gap between the first clips and the stationary plate by the other end;

an elastic member configured for movably connecting the main pressure plate to the stationary plate;

an auxiliary plate; and a pivot rod configured for pivoting the auxiliary plate and main pressure plate.

2. The media fixing device as claimed in claim 1, wherein each of the first and second linking bars comprises a sliding portion positioned in the gaps, and two pivot portions connected on the sliding portion by two connecting portions and pivoted on the joining members.

3. The media fixing device as claimed in claim 1, wherein each of the first and second joining member comprises a plate with a fulcrum hole defined therein, each pair of the fulcrum holes of a pair of joining members on the same plate defining a pivot axis; away from which the first and second clips are formed on the stationary plate and the main pressure plates.

4. The media fixing device as claimed in claim 1, wherein each clip comprises a first portion extending upwards from the plate on which it is formed and a second portion extending from the first portion away from the pivot axis defined by the fulcrum holes.

5. The media fixing device as claimed in claim 3, wherein the main pressure plate further comprises an auxiliary clip formed on the connecting surface of the main pressure plate between the second clips; the auxiliary clip comprises a first portion extending upwards from the connecting surface, and a second portion extending from the first portion and towards the pivot axis is defined by the fulcrum holes of the second joining members, wherein the first portion of the auxiliary clip is dislocated from a connecting line between the second clips away from the pivot axis defined by the fulcrum holes of the second joining member.

6. The media fixing device as claimed in claim 1, wherein the main pressure plate further comprises a pair of third joining members formed at an edge of the connecting surface, and each of the joining members defines a fulcrum hole therein through which the pivot rod pivots to rotatably connect the auxiliary plate to the main pressure plate.

7. The media fixing device as claimed in claim 6, wherein the auxiliary plate comprises a pair of fourth joining members corresponding to the third joining members of the main pressure plate, wherein each of the joining members defines a fulcrum hole therein through which the pivot rod is received and pivots on the third joining members of the main pressure plate.

8. The media fixing device as claimed in claim 7, wherein the auxiliary plate comprises a connecting portion rotatably connected on the main pressure plate and an arched portion connected on the connecting portion.

9. The media fixing device as claimed in claim 8, wherein the arched portion comprises an upper end and a lower end and is connected on the connecting portion by the upper end, and wherein the concavity of the arched portion faces downwards.

10. The media fixing device as claimed in claim 9, wherein the connecting portion of the auxiliary plate defines an opening on an edge thereof away from the arched portion, the opening is surrounded by a bottom wall and two parallel sidewalls symmetrically connected to two opposite ends of the bottom wall, and the fourth joining members are respectively formed on the auxiliary plate along the sidewalls.

11. The media fixing device as claimed in claim 10, wherein the auxiliary plate further comprises a pair of fourth clips separately and perpendicularly formed thereon along the bottom wall, each comprising a first portion extending from the auxiliary plate and a second portion extending from the first portion towards the opening.

12. The media fixing device as claimed in claim 11, wherein the auxiliary plate defines a sliding slot on the middle thereof, impelling the auxiliary plate from the bottom wall to the lower end of the arched portion.

13. The media fixing device as claimed in claim 11, wherein an end of the sliding slot adjacent to the bottom wall is wider than other portions of the sliding slot.

14. The media fixing device as claimed in claim 1, wherein the elastic member is a volute spring.

15. The media fixing device as claimed in claim 14, wherein the stationary plate further comprises at least one locating seat formed on the stationary plate, on which the elastic member is mounted by one end.

16. The media fixing device as claimed in claim 15, wherein the locating seat comprises three symmetrically distributed retaining tabs.

17. The media fixing device as claimed in claim 16, wherein the main pressure plate further comprises at least one locating ring corresponding to the locating seat of the stationary plate, and the other end of the at least one elastic is mounted on the locating seat.

* * * * *